US008573885B2

(12) United States Patent
Latham

(10) Patent No.: US 8,573,885 B2
(45) Date of Patent: Nov. 5, 2013

(54) ROAD SURFACE PLANAR

(75) Inventor: Winchester E. Latham, Avon, IN (US)

(73) Assignee: Winchester E. Latham, Avon, IN (US)

( * ) Notice: Subject to any disclaimer, the term of this patent is extended or adjusted under 35 U.S.C. 154(b) by 293 days.

(21) Appl. No.: 12/945,023

(22) Filed: Nov. 12, 2010

(65) Prior Publication Data

US 2012/0121330 A1 May 17, 2012

(51) Int. Cl.
*E01C 23/16* (2006.01)
*E21C 25/00* (2006.01)

(52) U.S. Cl.
USPC ..... 404/94; 299/39.5

(58) Field of Classification Search
USPC ..... 404/94; 299/39.1, 39.4–39.8; 15/82; 172/799.5, 810, 817, 832, 833, 834, 172/776; 37/241, 242
See application file for complete search history.

(56) References Cited

U.S. PATENT DOCUMENTS

| | | | | |
|---|---|---|---|---|
| 1,630,422 | A | 5/1927 | Gillespie | |
| 3,767,262 | A | 10/1973 | Pentith | 299/10 |
| 3,888,542 | A | 6/1975 | Gowler | 299/1 |
| 4,154,481 | A | 5/1979 | Heckenhauer et al. | 299/39 |
| 4,256,344 | A | 3/1981 | Hatcher | 299/39 |
| 4,333,686 | A | 6/1982 | Arnswald | 299/39 |
| 4,387,929 | A | 6/1983 | Wirtgen | 299/39 |
| 4,458,949 | A | 7/1984 | Jury | 299/41 |
| 4,473,319 | A | 9/1984 | Spangler | 404/72 |
| 4,516,808 | A | 5/1985 | Staab et al. | 299/39 |
| 4,714,374 | A | 12/1987 | Mihara | 404/91 |
| 4,749,048 | A | 6/1988 | Kelly | 172/699 |
| 4,808,026 | A | 2/1989 | Clarke, Jr. et al. | 404/90 |
| 4,878,713 | A | 11/1989 | Zanetis | 299/39 |
| 5,098,252 | A | 3/1992 | Sheesley et al. | 414/723 |
| 5,121,557 | A * | 6/1992 | Moore | 37/406 |
| 5,203,615 | A | 4/1993 | Zanetis et al. | 299/39 |
| 5,299,857 | A * | 4/1994 | Zanetis | 299/30 |
| 5,354,146 | A | 10/1994 | O'Konek | 404/90 |
| 5,378,080 | A * | 1/1995 | Dickson | 404/90 |
| 5,378,081 | A | 1/1995 | Swisher, Jr. | 404/90 |
| 5,382,084 | A | 1/1995 | Diver et al. | 299/39 |
| 5,391,017 | A * | 2/1995 | Thomas et al. | 299/39.6 |
| 5,403,144 | A | 4/1995 | Staben, Jr. | 414/697 |
| 5,713,418 | A | 2/1998 | Warren et al. | 172/40 |
| 6,035,478 | A * | 3/2000 | Miller et al. | 15/82 |
| 6,116,699 | A | 9/2000 | Kaczmarski et al. | 299/39.5 |

(Continued)

OTHER PUBLICATIONS

Tilt-Tatch Attachment, 2010, pp. 1 -3, Bobcat, available at http://www.bobcat.com/attachments/tilt_tatch.

*Primary Examiner* — Matthew D Troutman
(74) *Attorney, Agent, or Firm* — Brinks Hofer Gilson & Lione

(57) ABSTRACT

A road surface planner having a coupling mechanism coupled between a working tool attachment and a transporter to permit independent movement (i.e., rotation and/or pivoting) between the transporter and the attachment is provided. The attachment can have a rotary driven element such as a grinding element for modifying an irregular surface of existing pavement. The rotary element can be supported by a rear frame with a rear wheel assembly, a boom at the front of the grinding element, and a front wheel assembly coupled to the boom. The coupling mechanism can include a first member pivotably coupled to the transporter, and a second member fixed to the rear frame. The first member has a central opening defined by an inner edge for slidably contacting along a hub that extends from the second member for rotation there along.

20 Claims, 6 Drawing Sheets

(56) References Cited

U.S. PATENT DOCUMENTS

| | | | | |
|---|---|---|---|---|
| 6,176,551 | B1 | 1/2001 | Page | 299/39.1 |
| 6,227,620 | B1 | 5/2001 | Page | 299/39.4 |
| 6,328,387 | B1 * | 12/2001 | Cooper et al. | 299/39.6 |
| 6,499,809 | B1 | 12/2002 | O'Konek | 299/39.6 |
| 6,520,593 | B2 | 2/2003 | Dvorak et al. | 299/39.5 |
| 6,682,261 | B1 | 1/2004 | Karamihas et al. | 404/75 |
| 7,029,072 | B1 | 4/2006 | Murray et al. | 299/39.5 |
| 7,029,370 | B2 | 4/2006 | Cochran et al. | 451/11 |
| 7,748,789 | B2 | 7/2010 | Freeburn | 299/39.5 |
| 2009/0232598 | A1 * | 9/2009 | Cochran et al. | 404/86 |

* cited by examiner

ROAD SURFACE PLANAR

BACKGROUND

The present disclosure relates to equipment for modifying the surface of an existing road, and in particular, to equipment for smoothing areas of existing pavement by removing bumps, upward projections, and other surface irregularities.

Road planning machines are used to remove bumps and other irregularities on the surface of a road, runway, taxiway, or other stretch of pavement. This planning effect is typically achieved by grinding the paved surface so that the grinding depth may vary slightly, but the surface produced by the grinding unit is more level than the original surface. The road planning machine typically includes a grinding unit that is powered by an engine or motor. A tractor is attached to, or integral with, the grinding unit for propelling the grinding unit against the paved surface in a desired direction.

One problem that exists in road planning machines is accurate control of the grinding unit and consistent grinding performed by the unit. This is especially true when it is desirable to produce the aforementioned planning effect by a tractor such as a skid steer loader having the grinding unit as an attachment. Any movement of the skid steer loader caused by, for example, crossing a bump or a recess in the paved surface, can affect the accuracy and quality of the planning effect. In other words, as a skid steer loader crosses a change in elevation in the paved surface, the rotary grinding unit is lifted or lowered by the degree of elevation change (or may even be rotated by a pitch angle) from the paved surface, thereby causing an uneven planning effect. In a similar fashion, as a skid steer loader crosses a change in lateral elevation in the paved surface, the rotary grinding unit is tilted to one side relative to the other by the degree of lateral elevation change (or may even be rotated by a roll angle) from the paved surface, thereby causing an uneven planning effect.

Thus, there remains a need for a pavement grinding apparatus designed to remove bumps and other irregularities from the surface of a road, runway, taxiway, or other pavement for a desired pavement profile. In particular, it would be desirable to obtain the desired pavement profile regardless of vertical or lateral elevation movement of the transporter relative to the grinding unit.

SUMMARY

A planar attachment for a transporter is provided for obtaining a desired pavement profile regardless of vertical or lateral elevation movement of the transporter typically associated with standard operation. The planar attachment includes a grinding element configured to modify a surface of existing pavement. An enclosure generally encloses the grinding element except on a downward facing side confronting the pavement surface. A source of power may be coupled to the transporter or the grinding element for powering the grinding element. A rear frame assembly can be coupled to a rear surface of the grinding element enclosure. A rear wheel assembly can be supported by the rear frame assembly. A boom can be coupled to a front surface of the grinding element enclosure. A front wheel assembly can be coupled to an end of the boom. A coupling mechanism can be coupled between the rear frame assembly and a mounting plate that is adapted to couple to the transporter. The coupling mechanism can be configured to permit pivot and/or rotation of the planar attachment relative to the transporter.

A road surface planar for modifying a surface of existing pavement into a planning profile is provided. The road surface planar can include a transporter coupled to a grinding element via a rotating coupling mechanism. The transporter can have a frame, a mover means supporting the transporter frame above an existing pavement surface, and a motor coupled to the mover means for propulsion of the transporter relative to the pavement surface. The grinding element can be configured to modify the existing pavement surface. An enclosure can generally enclose the grinding element except on a downward facing side confronting the pavement surface. A source of power may be provided to power the grinding element. A rear frame assembly can be coupled to a rear surface of the grinding element enclosure. At least one pair of rear wheel assemblies can be coupled to the rear frame assembly, with each rear wheel assembly in a pair laterally spaced apart from one another. A boom can be coupled to a front surface of the grinding element enclosure. A front wheel assembly can be coupled to a front end of the boom. The rotating coupling mechanism may include a first attachment member pivotably coupled to a mounting plate that is attached to the transporter. The first attachment member can have a central opening defined by an inner edge. A second attachment member can be fixed to the rear frame assembly and can have a hub extending along a rotation axis. The hub can be situated within the central opening and sized to slidably contact the inner edge, whereby the planning effect of the grinding element remains substantially unaffected due to a change in elevation of the transporter.

Further provided is a working tool attachment for a transporter and coupled thereto through a mounting plate. The working attachment tool can include a rotary driven element configured to engage a surface of pavement, and generally enclosed by an enclosure except on a downward facing side confronting the pavement surface. A source of power may be provided to power the rotary driven element. A rear frame assembly can be coupled to a rear surface of the rotary driven element enclosure. A rotatable coupling mechanism is provided to couple the working tool attachment to the transporter. The rotatable coupling mechanism can include a first attachment member pivotably coupled to the transporter by the mounting plate. The first attachment member can have a central opening defined by an inner edge. The second attachment member can be fixed to the rear frame assembly and can have a hub extending along a rotation axis for the working tool attachment. The hub can be situated within the central opening and sized to slidably contact the inner edge. The first attachment member can further include at least one slot spaced radially from the central opening. The second attachment member can further include at least one pin extending axially from a rear face of the second attachment member. The pin can have a cross-section sized to fit within the slot, so that the slot and pin arrangement can limit the range of rotation of the working tool attachment.

In one example, the first attachment member may include a rear attachment plate and a bearing plate coupled to one another. The rear attachment plate can be pivotably coupled to the transporter by the mounting plate. The pivoting of the working tool attachment relative to the transporter can be along a pivot axis that is substantially orthogonal to the rotation axis. The rear attachment plate can have an intermediate opening and at least one first slot spaced radially from the intermediate opening. The bearing plate can have the central opening defined by the inner edge and the at least one slot spaced radially from the central opening. The pin can have a first cross-section sized to fit within the slot of the bearing plate, and a second cross-section sized, greater than the first cross-section, to fit with the first slot of the rear attachment plate and greater than a radial distance of the slot of the bearing plate.

DESCRIPTION OF PREFERRED EMBODIMENTS

Figure 1:
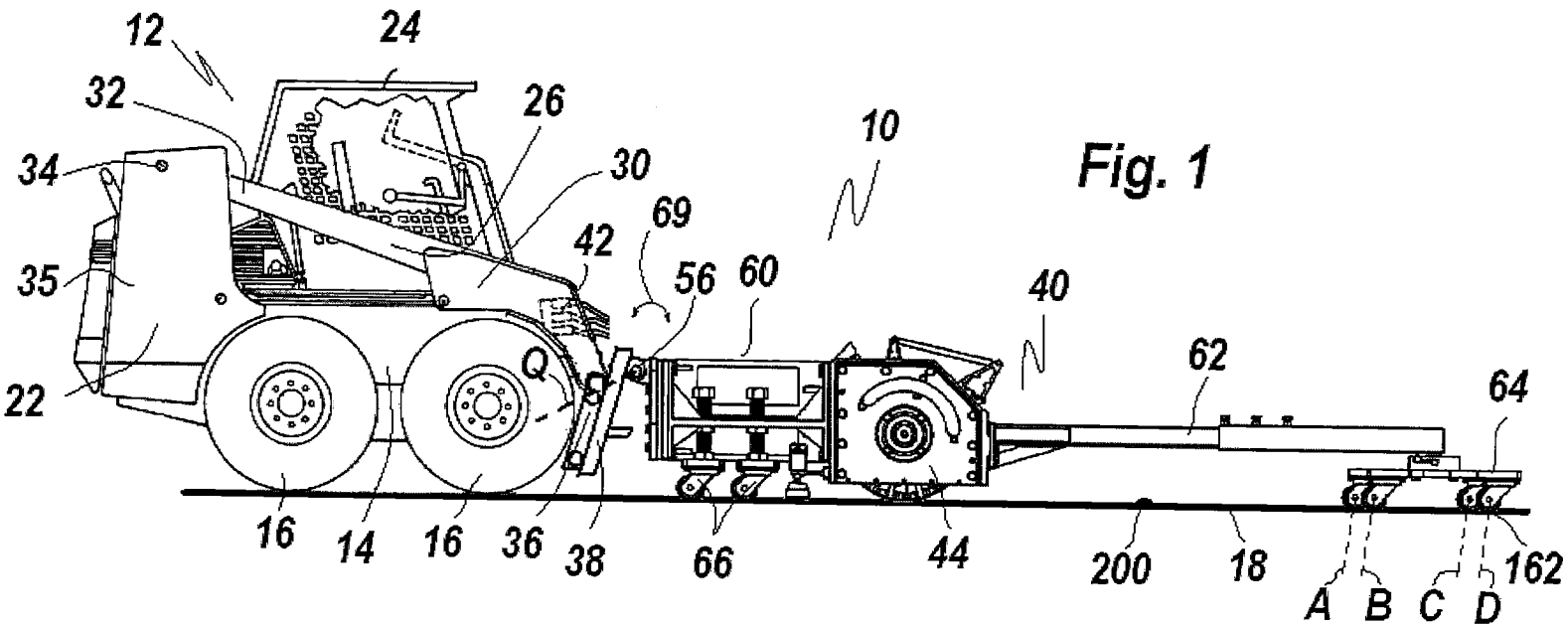
FIG. 1 is a side view of a road surface planar system.

For the purposes of promoting an understanding of the principles of the present disclosure, reference will now be made to the embodiments illustrated in the drawings, and specific language will be used to describe the same. It should nevertheless be understood that no limitation of the scope of the invention is thereby intended, such alterations and further modifications in the illustrated embodiments, and such further applications of the principles of the present disclosure as illustrated therein being contemplated as would normally occur to one skilled in the art to which the invention relates. In certain aspects, identical reference numerals will be used throughout all of the figures to designate identical structural features when appropriate.

FIG. 1 depicts a road surface planar system 10 that can be used to remove bumps and other irregularities from the surface of a road. For example, the system 10 can be used to remove a desired bump elevation, such as, e.g., between about 0-2 inches or more, in order to smooth the pavement surface. The system 10 can include a transporter such as a skid steer loader 12. Skid steer loader 12 can include a frame 14 supported by wheels 16 above an existing underlying pavement surface 18, although other means of maneuverability and movement such as a track-driven power machine can be used as appreciated by those skilled in the art. A motor 22 can be coupled to the wheels 16 for propulsion of the loader 12 relative to the underlying pavement surface 18. The frame 14 can support a cab 24 that defines an operator compartment and can substantially enclose a seat on which the operator seats to control the loader 12. Loader 12 can include a lift frame assembly 26 that includes a pair of lift arms 30 which are disposed on either side of the cab 24. The lift arms 30 can include upper ends 32 that terminate at a pivotal base 34. The pivotal base 34 can extend at a rear portion 35 of the loader frame 14, which is disposed behind the cab 24, and which can enable the each lift arm 30 to pivot thereto. The lift arms 30 can also have a lower end 36 that is adapted for connection to a working tool such as a planar attachment 40 through a universal mounting plate 38 that is modified as described below. Loader 12 preferably has a hydraulic power unit 42 which can be utilized to lift the lift frame assembly 26 (generally through one or more hydraulic cylinders attached to the lift frame assembly). Hydraulic power unit 42 can also direct hydraulic fluid to other hydraulic motor driven components such as, e.g., a grinding element 44 which is mounted to the planar attachment 40, as described in more detail hereinbelow. The direction and speed of the loader 12 as well as the lifting of the lift frame assembly 26 can be controlled in a conventional manner by controls situated in cab 24. It can be appreciated by those skilled in the art various components may also be electrically powered and/or gas-engine powered, in addition to or instead of the hydraulically powered.

Figure 2:
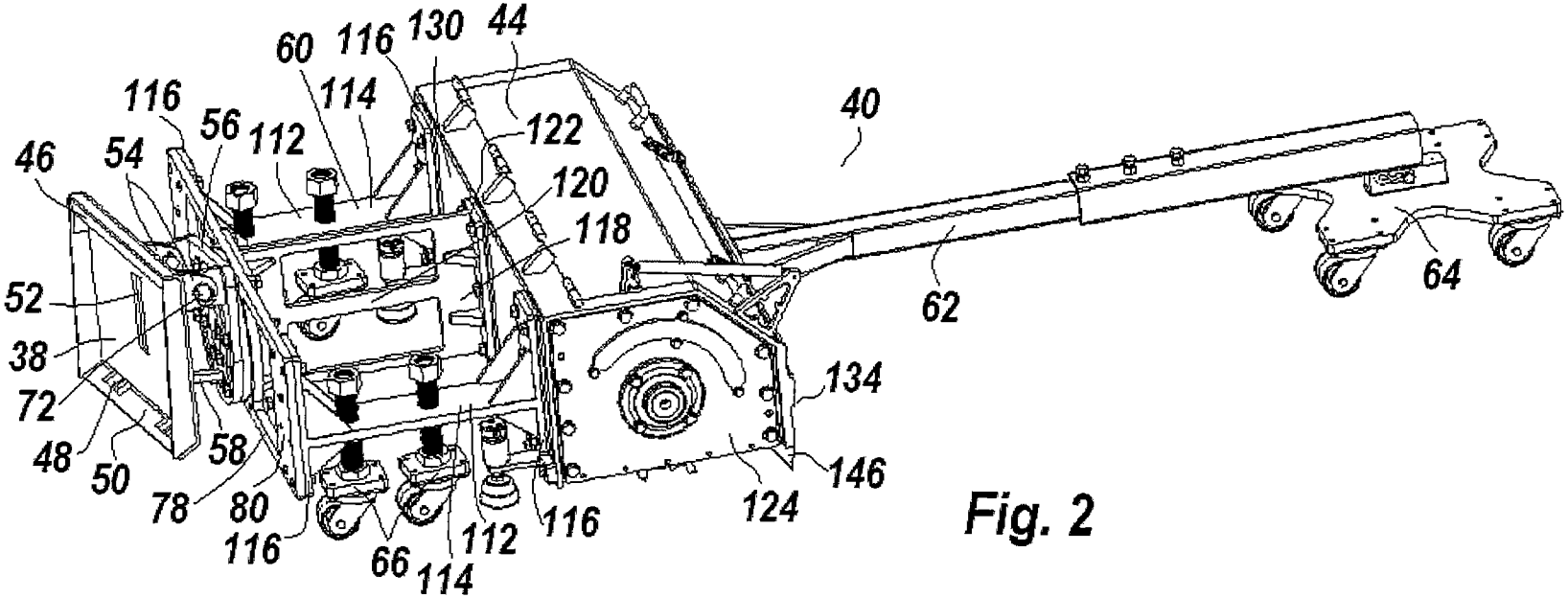
FIG. 2 is a perspective view of a planar attachment that is connectable to a skid steer loader.

Removal and attachment of the planar attachment 40 relative to the loader 12 is facilitated by the mounting plate 38, as shown in FIG. 2. Mounting plate 38 can be in the form a generally rectangular enclosure having a retainer bracket 46 along the upper portion of the rear face of the mounting plate. The retainer bracket 46 can be sized for receiving an upper margin of an adaptor plate (not shown) of the loader 12. Mounting plate 38 can also include lock ports 48 formed in a lower horizontal shelf 50 on the mounting plate 38. Lock pins (not shown) of the loader 12 can be removably attached through the lock ports 48 to facilitate detachment of the planar attachment 40 from the loader 12. A pair of clevises 54 can be attached to the front face of the mounting plate 38, which can be spaced horizontally apart. Clevises 54 can facilitate pivotal attachment to a rotating coupling mechanism 56 of the planar attachment 40 as described below, thereby allowing the planar attachment to pivot up-and-down Relative to the loader. A physical stop 58 such as a modified pipe can be attached to the front face of the mounting plate 38, which can extend outward in the forward direction. The length of the physical stop 58 can limit the relative pivotal motion between the loader 12 and the planar attachment 40. This feature can prevent premature damage to the rotating coupling mechanism 56 caused by the mounting plate 38 and can facilitate suspension of the planar attachment 40 above the pavement surface 18 for transporting the planar attachment.

In FIG. 2, a rear frame assembly 60 can couple the rotating coupling mechanism 56 to a rear facing surface 130 of the grinding element 44. A boom 62 can be attached to a front facing surface 134 of the grinding element 44, which can extend outward in the forward direction. A front wheel assembly 64 can be attached to a front end of the boom 62, and one or more rear wheel assemblies 66 can be attached to the rear frame assembly 60. The front wheel assembly 64 and the rear wheel assembly 66 can facilitate stability and movement of the planar attachment 40 and the grinding element 44. The front wheel assembly and the rear wheel assembly may be spaced apart as far as possible so that when the front wheel assembly contacts pavement surface imperfections, the grinding depth of the grinding element remains substantially unaffected. For example, the spacing between the wheel assemblies can be up to about 30 feet, and is typically about 20 feet, although it is contemplated that the spacing can be any distance depending on the application.

Figure 3:
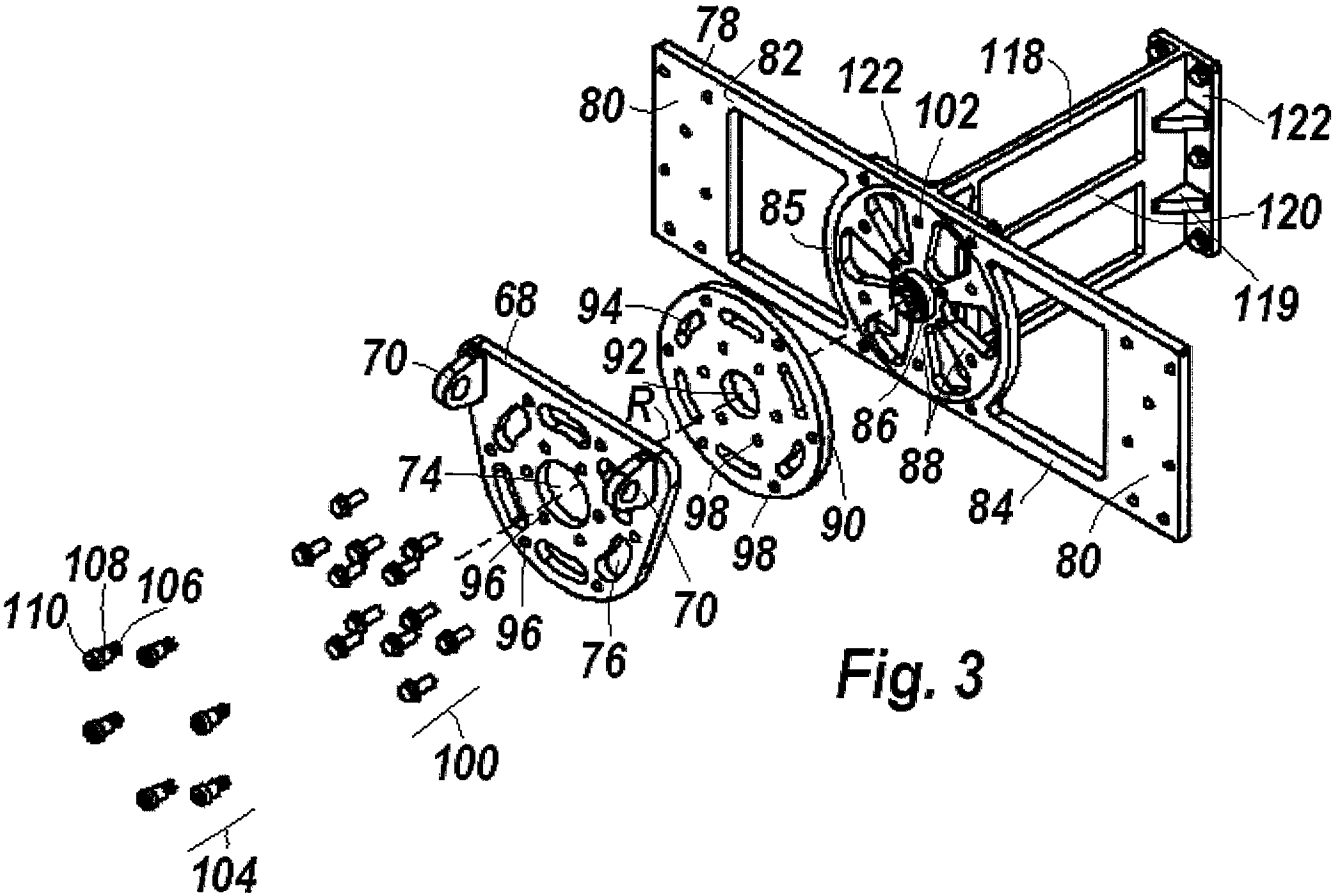
FIG. 3 is a perspective exploded view of a rotating coupling mechanism.
Figure 4:
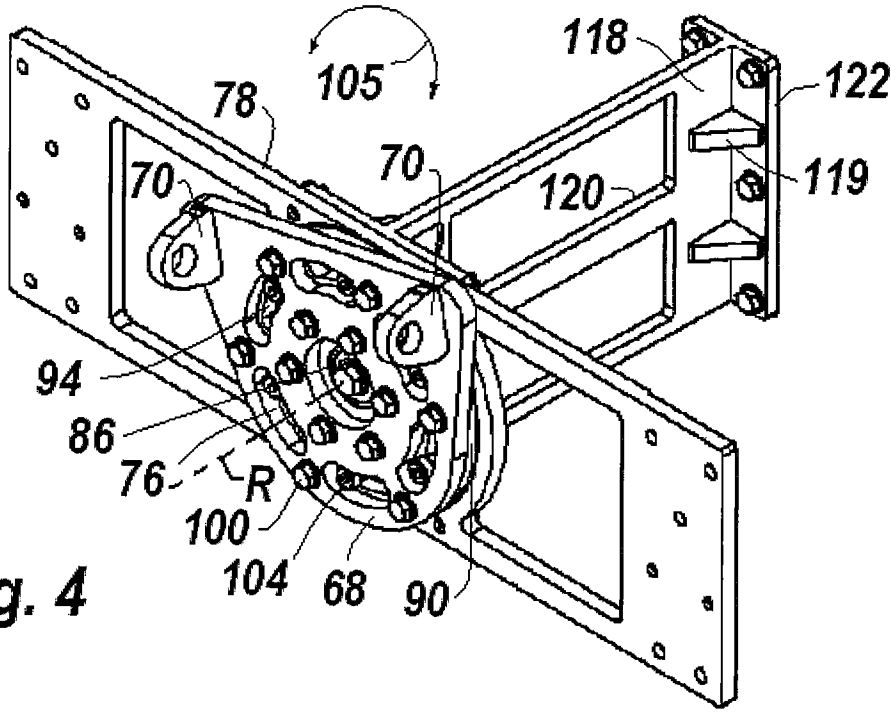
FIG. 4 is a perspective view of a rotating coupling mechanism.

FIGS. 3-4 illustrate various components of the rotating coupling mechanism 56 and their attachment between the mounting plate 38 and a portion of the rear frame assembly 60. Rotating coupling mechanism 56 can be configured to reduce the risk of movement transferred between the planer attachment 40 and the loader 12. That is, the rotating coupling mechanism 56 can effectively isolate the planar attachment 40 from the loader 12 so that any undesirable movement caused by the loader 12 does not substantially impact the accuracy and quality of the planning effect of the planar attachment 40. Thus, as the loader 12 crosses a bump or a recess that can cause a change in elevation in the pavement surface 18, the grinding element 44 of the planar attachment 40 can remain in position for effective bump elevation removal. Further, as the loader 12 is tilted laterally due to the pavement surface, the grinding element 44 of the planar attachment 40 can remain in position for effective bump elevation removal.

In FIG. 3, the rotating coupling mechanism 56 can include a rear attachment plate 68 for attachment to the mounting plate 38 so that the planar attachment 40 can pivot about an axis Q, represented by arrows 69, relative to the loader 12. A pair of tangs 70 can be attached to the rear face of the rear attachment plate 68, and spaced apart generally horizontally to fit within the respective clevises 54 of the mounting plate 38. A clevis pin 72 with a cotter pin or a bolt-and-nut combination can be used to couple the clevis 54 of the mounting plate 38 with the tang 70 of the rear attachment plate 68, as shown in FIG. 2. The pivotal attachment arrangement can facilitate the independence of the loader from the planar attachment so that as the loader is lifted or lowered by the degree of elevation change (or caused to rotate by a pitch angle) from the pavement surface. To this end, an uneven planning effect caused by such movement of the loader can be substantially avoided. Rear attachment plate 68 can also include a central opening 74 about an axis of rotation R, which is shown as circular but can be any shape. Axis of rotation R can be substantially orthogonal to the pivot axis Q. A plurality of slots 76 can be located radially spaced from the central opening 74. The radius of curvature of the slot 76, as well as lengths and radial thickness of the slot, can be substantially identical for each slot. It is preferred that each of the slots be circumferentially spaced from one another at about equal distances.

In FIG. 3, the rotating coupling mechanism 56 can include a front attachment plate 78 for attachment to the rear frame assembly 60. The front attachment plate 78 can be generally rectangular having a pair of lateral portions 80 interconnected to one another by an upper portion 82 and a lower portion 84. In the center of the front attachment plate 78 can be a wheel shaped member 85 having a hub 86 located in the center about the axis of rotation R, with a plurality of spoke members 88 extending radially from the hub 86. The hub 86 can be a cylindrical body or shaft that is attached and extends outward from the rear face of the front attachment plate 78. In one example, the wheel member 85 can have a counter bore formed therein to receive and support the hub 86, with the hub attached to the wheel member 86 with a bolt extending through the hub for attachment to a tapped opening in the wheel member. The surface of the hub 86 can be further configured as a smooth or lubricous surface to facilitate rotation therealong. In one example, a bushing or bearing can be positioned around the hub for reduced friction. One such bushing is the OILITE® bushing (Beemer Precisions, Inc., West Chester, Pa.), which can have a bronze surface and can be self-lubricating with oil based on reaching a pre-determined temperature.

A bearing plate 90 may be positioned in between the rear and front attachment plates 68, 78. Bearing plate 90 can be a disc body, and can have a central opening 92 about the axis of rotation R, which is preferably circular to receive the hub 86 for rotation there around. A plurality of slots 94 can be located radially spaced from the central opening 92. The inner edge that defines the central opening 92 contacts the hub 86 to facilitate relative rotation between the front attachment plate 78 and the bearing plate 90. The radius of curvature of the slot 94, as well as lengths and radial thickness of the slot 94, can be substantially identical for each slot. It is preferred that each of slots 94 be circumferentially spaced from one another at about equal distances. The slots 94 of the bearing plate 90 are preferably oriented in alignment with the slots 76 of the rear attachment plate 68. Although six slots 76 and six slots 94 are shown in the figures, it can be appreciated by those skilled in the art that any number of slots can be used.

A plurality of openings 96, 98 is formed in the rear attachment plate 68 and the bearing plate 90, respectively. The openings, which are preferably tapped, are oriented in alignment with each other in order to receive fasteners 100 for threadably coupling the rear attachment plate 68 to the bearing plate 90. As shown, an inner ring of fasteners and an outer ring of fasteners facilitate secure attachment therebetween. A plurality of openings 102 are formed in the front attachment plate 78, which can be positioned in the spoke members 88. The openings 102, which are preferably tapped, can be sized to receive a plurality of shoulder fasteners 104 for threadably coupling the front attachment plate 78 to the bearing plate 90.

Shoulder fasteners 104 can extend axially from the rear face of the front attachment plate 78 to be inserted into the respective slots 76, 94 of the coupled rear attachment plate 68 and the bearing plate 90. Shoulder fastener 104 can have a threaded portion 106 for insertion into the opening 102, an intermediate portion 108, and a head portion 110. Intermediate portion 108 can be sized to fit within the radial thickness of the slot 94 of the bearing plate 90. Head portion 110 forms the shoulder portion of the shoulder fastener 104, and is preferably sized to be greater than the radial thickness of the slot 94 of the bearing plate 90 to facilitate securing of the bearing plate against the front attachment plate. As shown, the head portion 110 can be sized to fit within the slot 76 of the rear attachment plate 68. Other attachment means between the various components can be, for example, by welding, soldering or attached by other means known to one skilled in the art. It can also be appreciated by those skilled in the art that one member can replace the two-member attachment mechanism, i.e., the rear attachment plate and the bearing plate, having at least some of the features described herein. However, a separate bearing plate can be beneficial as a sacrificial, inexpensive component that is designed to wear more quickly than other components, and which can be easily replaced as needed.

The combination of the shoulder fastener 104 and the respective slots facilitate the extent of relative rotation between the front attachment plate 78 and the coupled rear attachment plate 68 and the bearing plate 90 in a direction, represented by arrows 105, about the axis of rotation R. In other words, the length of the slot 94 defines limits of the degree of travel of the intermediate portion 108 of the shoulder fastener 104 within the slot. In the example of six slots shown in the figures, the degree of relative rotation can be about 45 degrees to about 55 degrees, although the degree of relative rotation can be any amount depending on the application. The rotational attachment arrangement can facilitate the independent movement of the loader from the planar attachment so that as the loader is lifted or lowered on one side relative to the other by the degree of lateral elevation change (or caused to rotate by a roll angle) from the pavement surface, an uneven planning effect caused by such movement of the loader is substantially avoided.

In FIG. 2, the rear frame assembly 60 includes a pair of lateral support members 112 coupling the lateral portions 80 of the front attachment plate 78 to the grinding element 44. Each of the lateral support member 112 can be in the shape of an "I-beam," which can include a horizontal cross member 114 interconnected between two vertical mounting plates 116 that are attached between the front attachment plate 78 and the grinding element 44, respectively. As shown in the figures, two pairs of rear wheel assemblies 66 can extend vertically from the cross member 114. The rear frame assembly 60 may include a central support member 118 coupling the center of the front attachment plate 78 to the grinding element 44. The central support member 118 can be in the shape of an "I-beam," which can include a vertical intermediate member 120 interconnected between two vertical mounting plates 122 that are attached between the front attachment plate 78 and the grinding element 44, respectively.

Each of the vertical mounting plates 116, 122 can include openings that are oriented in alignment with openings in the lateral portions 80 and upper and lower portions 82, 84 of the front attachment plate 78 and with openings in the grinding element enclosure, each for receiving fasteners such as bolts. The components may however be welded, soldered, or attached by other means known to one skilled in the art. For further strength, the lateral support members 112 and the central support member 118 can include a plurality of gussets 119 as shown in FIG. 2 to reinforce and strengthen the individual members to which the gussets are attached between.

Figure 5:
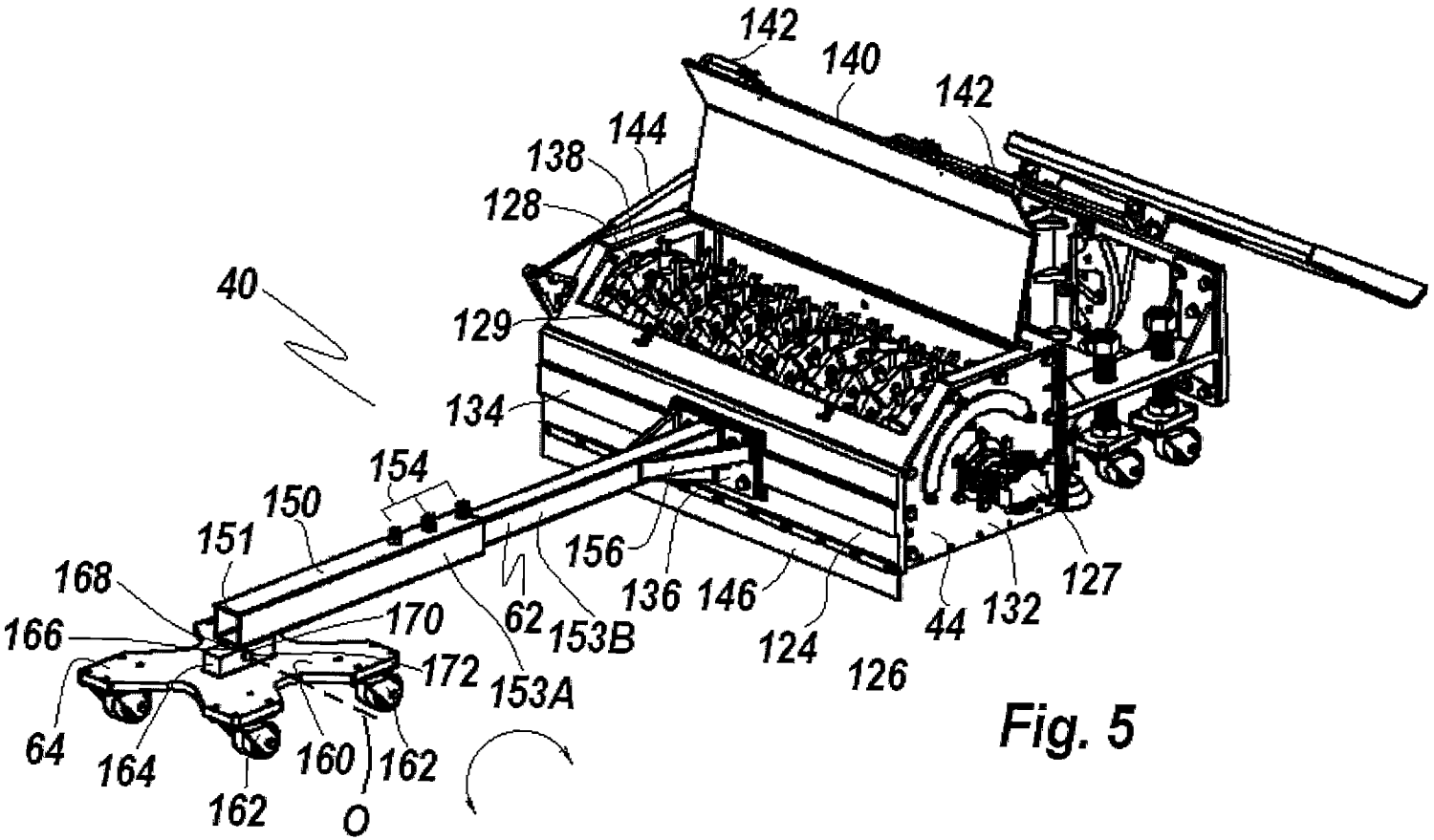
FIG. 5 is a perspective front view of a planar attachment.

In FIG. 5, the grinding element 44 is adapted for smoothing the existing underlying pavement surface 18. An enclosure 124 generally encloses the grinding element 44 except on a downward facing side 126 confronting the pavement surface 18. The hydraulic power unit 42 that is coupled to the frame 14 can power the grinding element 44, via a local hydraulic motor 127 mounted to the grinding element, by way of a suitable control located in cab 24. The grinding element 44 can take several forms including the form of a generally cylindrical drum 129 having a plurality of cutting elements 128 disbursed around and along the surface of the drum. One example of this arrangement is found in U.S. Pat. No. 7,108,212 to Latham, which is incorporated herein by reference in its entirety. The drum 129 can be mounted to the enclosure 124 so that the axis of rotation of the cylindrical surface is situated generally horizontally. The drum 129 can be driven for rotation by the motor 127, which receives hydraulic fluid from the hydraulic power unit 42. As hydraulic fluid under pressure is supplied to the motor 127, the drum 129 is driven for rotation in the cutting direction. The grinding element 44 can also take the form of at least one disk having a plurality of cutting elements disbursed over a lower substantially planar surface of the disk. The disk(s) can be mounted to the enclosure 124 so that the axes of rotation of the disk(s) are situated perpendicularly to the downward facing side 32. Other rotary driven elements are contemplated for use as the grinding element such as a rotary brush drum that can be used to sweep dust and debris.

According to FIGS. 2 and 5, the enclosure 124 of the grinding element 44 can include a rear facing surface 130 that is coupled to the vertical mounting plates 116, 122 of the rear frame assembly 60, as described above. A pair of lateral walls 132 can connect the rear facing surface 130 to a front facing surface 134 that is coupled to an attachment plate 136 of the boom 62. A top surface 138 can also connect the rear facing surface 130 to the front facing surface 134. A lid 140 can be hingedly mounted to the top surface 138 of the enclosure 124, and opened such as shown in FIG. 5 to provide access to the interior of the enclosure. Handles 142 can be provided on the lid 140, as well as a spring/dampening cylinder 144, to facilitate opening or closure of the lid. A dust curtain 146 can be attached along the lower side of the front facing surface 134 in order to inhibit dust from exiting the front side, which can obstruct the view of the operator during operation, and to inhibit rocks and debris from entering underneath the enclosure.

In FIG. 5, the boom 62 comprises a horizontal beam 150 having a rear end attached to the attachment plate 136, which is coupled to the front facing surface 134 of the grinding element enclosure 124. A front end 151 of the horizontal beam 150 can be attached to the front wheel assembly 64. The length of the horizontal beam 150 may be adjustable, e.g., by two-foot increments for a 20 foot boom. For example, the horizontal beam 150 may comprise a telescoping configuration with two more or more members, with FIG. 5 showing a first square pipe 153A receiving a second square pipe 153B. The position of the square pipes 153A-B can be adjusted by removing fasteners 154 from the openings and sliding the square pipes relative to one another and reattaching the fasteners to respective openings. The first square pipe 153A may be fully removable from the second square pipe 153B in order to shorten the system for facilitating transport thereof. The horizontal beam 150 can be extended substantially perpendicular to the attachment plate 136, and can be further supported by bracing members 156 that are attached between the attachment plate and the horizontal beam.

The front wheel assembly 64 can include a mounting plate 160 with one or more castors 162 attached to the underside of the mounting plate 160 for contacting the underlying pavement surface 18. Mounting plate 160 can be in the shape of an "X" and preferably as staggered "X" so that the rotation axis of a first caster can be offset from the rotation axis of a second caster by a longitudinal distance. As shown in FIG. 1, when four casters are included, the rotation axes A, B, C, and D of all four casters can be offset from another. The offset configuration can facilitate stability of the front wheel assembly 64 when one caster rolls across a recess or a bump in the pavement surface 18, leaving the remaining casters in rolling contact with the pavement surface. A mounting block 164 can be attached to the upper surface of the mounting plate 160 for facilitating coupling to the front end 151 of the horizontal beam 150 in a manner so that the mounting plate 160 can rotate or oscillate about an axis O during operation, as shown by the arrows. This arrangement can allow the front wheel assembly 64 the freedom to rotate as one of the casters encounters an obstruction in the pavement surface, such as a bump or recess, so the system better handles the forces caused thereby. The height of the mounting block 164 can facilitate the general positioning of the horizontal beam 150 in a substantially horizontal position. The mounting block 164 can include a bore 166 along the upper surface for receiving a vertical extending clevis 168 from the lower side of the horizontal beam 150. The mounting block 164 can also include a bore 170 extending laterally therethrough. A pin 172 can extend through the bore 170 and through an aperture in the clevis 168, fixed by a cotter pin, in order to facilitate attachment of the horizontal beam 150 to the front wheel assembly 64. Pin 172 can define the axis of rotation O by which the front wheel assembly 64 can pivot about in the front-rearward direction. It can be appreciated by those skilled in the art that the front wheel assembly can be coupled to the boom in a manner to permit pivoting in the left-right direction.

Figure 6:
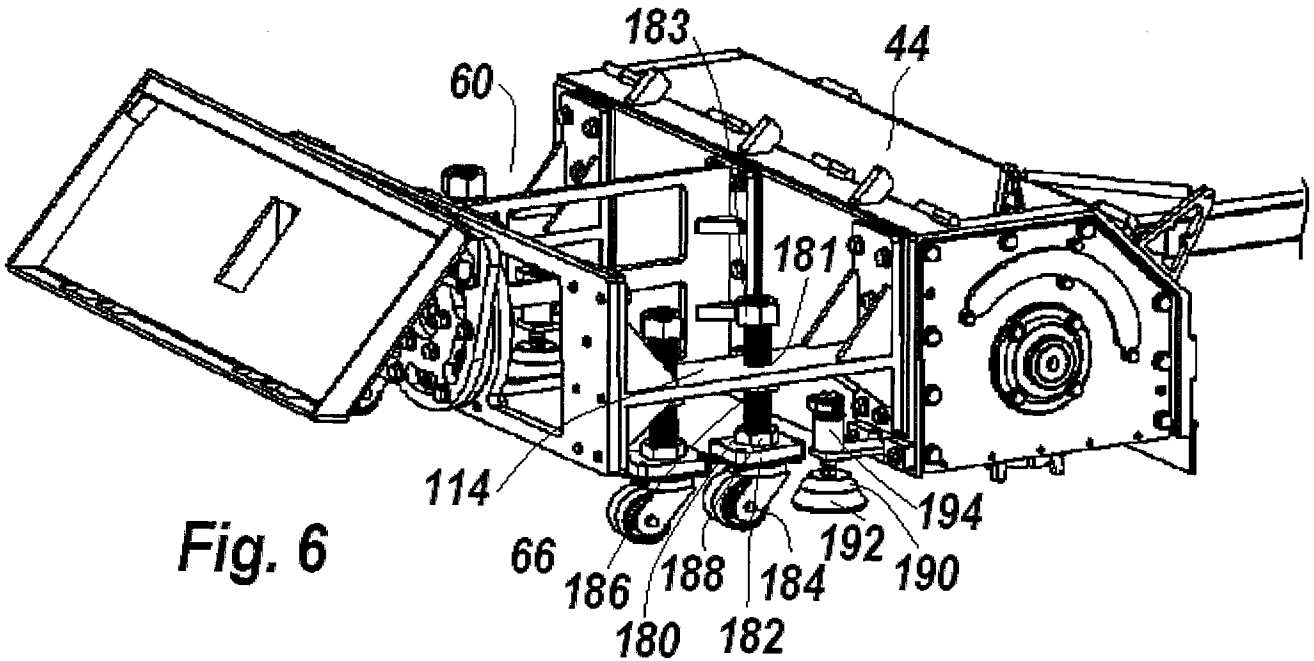
FIG. 6 is a perspective rear view of a planar attachment.

In FIG. 6, the rear wheel assembly 66 includes a vertical post 180 having an end attached to a mounting plate 182 with a castor 184 attached to the underside of the mounting plate 182 for contacting the underlying pavement surface 18. The vertical post 180 can extend through an opening 181 formed in the cross member 114. Preferably, the vertical post 180 is a threaded rod that threadably engages with the opening 181 that is tapped. The top end of the vertical post 180 includes an engaging head 183, such as a hex head, that is fixedly attached thereto, which is used to turn the vertical post 180 in either direction. A locking member 186, such as a nut, can be threadably attached to the vertical post 180 between the ends and tightened against the lower side of the cross member 114 to retain the vertical post 180 at a pre-set distance. An opening in the mounting plate 182 can be tapped to receive and threadably engage with the lower end of the vertical post 180, and a second locking member 188 can be used to lock the lower end in the mounting plate 188. Preferably, each vertical post is individually adjustable in order to selectively vary the elevation of the grinding element 44 according to the desired bump removal elevation.

A sweeper or brush 190 may also be attached to the grinding element enclosure 124 or the rear frame assembly 60 via a mounting bracket. Sweeper 190 is configured to remove debris or dust from the track of the rear wheel assemblies 66 in order to inhibit potential debris buildup along the wheels of casters 184, which can adversely alter the bump removal elevation. Sweeper 190 can have bristles 192 to contact the pavement modified by the grinding element 44, and rotate there along. Sweeper 190 can include a hydraulic motor 194 couple to the hydraulic power unit 42 to power the rotation of the bristles 192.

With reference to all of the figures, to modify the surface contour of existing pavement, a desired bump elevation is selected to be removed. A substantially uniform grinding depth can be selected, for example, 0.125-inch bumps. Alternatively, for laterally pitched road surfaces, the grinding depth can be laterally inclined toward one side in a manner to match the pitch and remove the desired bump elevation, e.g., 0.125-inch bumps.

The primary positioning of the grinding element is accomplished by selectively locating the vertical position of the rear wheel assemblies 66. To adjust the grinding depth accordingly, the grinding element 44, i.e., the drum 127, while in rotation, is lowered by adjusting each of the rear-most positioned rear wheel assemblies. The locking member 186 can be repositioned so that the vertical post 180 can be moved freely. A tool such as a wrench can be applied to the engaging head 183 fixed to the vertical post 180 to rotate each vertical post 180 within the opening 181 of the cross member 114. This rotation can cause the selective lowering of the grinding element 44 until the drum just nicks the pavement surface 18. This can give some indication to the operator, i.e., zero reference point, where to measure from when ultimately adjusting the grinding element to the final position for the desired bump elevation removal. The grinding element is then lowered to the desired grinding depth and profile. Thereafter, the locking member 186 can be repositioned against the cross member 114 to lock the vertical post 180 in place. The next forward rear wheel assembly adjacent the rear-most one is then adjusted in a similar manner to be at least the same elevation as the rear-most one if not slightly less, such as 0.005 to about 0.015 inches less, i.e., hardly touching the underlying pavement surface. In other words, the rear-most rear wheel assemblies can be used to set the general depth and angle of the grinding element. Other rear wheel assemblies can be for added security and stability in the case the rear most wheel assemblies traverse into a recess in the pavement surface. When the grinding depth is to be inclined, then one side of the rear wheel assemblies is adjusted accordingly to achieve an angle of up to about 5 degrees, for example.

In operation, after the grinding element 44 is positioned at the desired elevation relative to the pavement surface and/or angle, the grinding element is powered and the loader 12 is moved in a forward direction. A bump or surface irregularity 200 (FIG. 1) is positioned between the front and rear wheel assemblies 64, 66. The grinding element can be applied against the bump 200 one or more times, thereby removing the entire bump or segments of the bump and effectively smoothing the pavement surface. A more consistent profile produced by the grinding element 44 can be facilitated by additional length between the rear wheel assembly 66 and the front wheel assembly 64. The rotating coupling mechanism 56 can permit the independent movement (i.e., rotation about axis R and pivoting about axis Q) between the planar attachment 40 and the loader 12, that is, the planar attachment is free floating with respect to the loader. In other words, during operation the grinding element is allowed to remain positioned along the pavement surface at an effective bump elevation for a desired planning effect to remove the bumps, whether or not the loader 12 is contacting the pavement surface along the same plane as the grinding element 40.

Drawings in the figures illustrating various embodiments are not necessarily to scale. Some drawings may have certain details magnified for emphasis, and any different numbers or proportions of parts should not be read as limiting, unless so designated in the present disclosure. Those of skill in the art will appreciate that embodiments not expressly illustrated herein may be practiced within the scope of the present invention, including those features described herein for different embodiments may be combined with each other and/or with currently-known or future-developed technologies while remaining within the scope of the claims presented here. It is therefore intended that the foregoing detailed description be regarded as illustrative rather than limiting. And, it should be understood that the following claims, including all equivalents, are intended to define the spirit and scope of this invention.

What is claimed is:

1. A planar attachment for a transporter and coupled thereto by a mounting plate, the planar attachment comprising:

a grinding element configured to modify a surface of existing pavement, an enclosure generally enclosing the grinding element except on a downward facing side confronting the pavement surface, a source of power coupled to the transporter to power the grinding element;

a rear frame assembly coupled to a rear surface of the grinding element enclosure;

a rear wheel assembly supported by the rear frame assembly;

a boom coupled to a front surface of the grinding element enclosure;

a front wheel assembly coupled to an end of the boom; and a coupling mechanism coupled between the rear frame assembly and said mounting plate, the coupling mechanism configured to permit pivot and rotation of said planar attachment relative to said transporter;

where the coupling mechanism comprises a first attachment member and a second attachment member rotatably coupled to one another, one of the first attachment member and the second attachment member is configured to attach to the mounting plate, the other of the first attachment member and the second attachment member is coupled to the rear frame assembly, and the attachment between one of the first attachment member or the second attachment member and the respective one of the mounting plate or the rear frame assembly is a pivotal attachment.

2. The planar attachment of claim 1, where the first attachment member comprises a central opening, and the second attachment member comprises a hub extending along a rotation axis and received within the central opening so that the first attachment member rotates relative to the second attachment member.

3. The planar attachment of claim 2, where one of the first and second attachment members includes at least one slot and the other includes at least one pin insertable into said at least one slot, the slot and pin arrangement configured to limit the range of rotation of the first attachment member relative to the second attachment member.

4. The planar attachment of claim 3, where the first attachment member includes the at least one slot, and the second attachment member includes the at least one pin.

5. The planar attachment of claim 4, where the at least one slot is spaced radially from the central opening, and extends circumferentially with respect to the central opening to define limits of the range of rotation.

6. The planar attachment of claim 4, where the first attachment member is configured to attach to the mounting plate, the second attachment member is coupled to the rear frame assembly, and the at least one pin extends axially from a rear face of the second attachment member and comprises a first cross-section sized to fit within the at least one slot and a second cross-section sized greater than a dimension of the at least one slot in a radial direction.

7. The planar attachment of claim 2, where the first attachment member is pivotably coupled to said mounting plate by one or more pivot elements.

8. The planar attachment of claim 1, where the rear wheel assembly is vertically adjustable to vary the position of the grinding element relative to the pavement surface.

9. The planar attachment of claim 1, where the rear frame assembly further comprises a duster element situated in front of the rear wheel assembly to inhibit dust buildup at the rear wheel assembly.

10. The planar attachment of claim 1, where the front wheel assembly comprises a mounting plate coupled to the end of the boom and at least four wheel assemblies each comprising a castor attached to an underlying surface of the mounting plate and having an axis of rotation substantially perpendicular to the underlying surface of the mounting plate, each of the at least four wheel assemblies laterally spaced apart from one another to offset the axis of rotation of each of the at least four wheel assemblies.

11. The planar attachment of claim 10, where the front wheel assembly is capable of pivoting about the end of the boom.

12. The planar attachment of claim 2, further comprising a bearing plate positioned between the first attachment member and the second attachment member and comprising a central opening defined by an inner edge, where the bearing plate is fixedly attached to the first attachment member, and the hub of the second attachment member is received within the central opening of the bearing plate and is sized to slidably contact the inner edge so that the first attachment member and the bearing plate rotate relative to the second attachment member.

13. A road surface planar for removing bumps or surface irregularities from a surface of existing pavement, comprising:

a transporter having a frame, a mover means supporting the transporter frame above an existing pavement surface, and a motor coupled to the mover means for propulsion of the transporter relative to the pavement surface;

a grinding element configured to modify the existing pavement surface, an enclosure generally enclosing the grinding element except on a downward facing side confronting the pavement surface, a source of power coupled to the transporter to power the grinding element;

a rear frame assembly coupled to a rear surface of the grinding element enclosure;

at least one pair of rear wheel assemblies coupled to the rear frame assembly, with each rear wheel assembly in a pair laterally spaced apart from one another;

a boom coupled to a front surface of the grinding element enclosure;

a front wheel assembly coupled to a front end of the boom; and a rotating coupling mechanism comprising a first attachment member pivotably coupled to a mounting plate attached to the transporter, the first attachment member having a central opening, and a second attachment member fixed to the rear frame assembly and having a hub extending along a rotation axis, the hub situated within the central opening to permit rotation of the first attachment member and the second attachment member relative to one another, whereby the planning profile of the grinding element remains substantially unaffected due to a change in elevation of the transporter.

14. The road surface planar of claim 13, where one of the first and second attachment members includes at least one slot and the other includes at least one pin insertable into said at least one slot, the slot and pin arrangement configured to limit the range of rotation of the first attachment member relative to the second attachment member.

15. The road surface planar of claim 14, where the first attachment member includes the at least one slot, the at least one slot spaced radially from the central opening, and extending circumferentially with respect to the central opening to define limits of the range of rotation.

16. The road surface planar of claim 15, where the second attachment member includes the at least one pin, the at least one pin extending axially from a rear face of the second attachment member, having a first cross-section sized to fit within the at least one slot and a second cross-section sized greater than a dimension of the at least one slot in a radial direction.

17. The road surface planar of claim 13, where the rear frame assembly comprises a cross member having a tapped opening for each rear wheel assembly of the at least one pair of rear wheel assemblies, each rear wheel assembly comprising a threaded vertical post threadably engaged with the tapped opening so that rotation of the vertical post within the tapped opening causes vertical adjustment of each rear wheel assembly in order to vary the position of the grinding element relative to the existing pavement surface.

18. The road surface planar of claim 17, where the at least one pair of rear wheel assemblies comprises a first pair of rear wheel assemblies and a second pair of rear wheel assemblies spaced longitudinally from one another.

19. The road surface planar of claim 13, where the front wheel assembly comprises a mounting plate coupled to the front end of the boom, and capable of pivoting about the front end of the boom.

20. The road surface planar of claim 13, where the boom extends from the front surface of the grinding element enclosure in a forward direction away from the transporter, and the front wheel assembly is spaced from at least one of the rear wheel assemblies by a distance of about 20 feet to about 30 feet.

* * * * *